United States Patent [19]

Madsen

[11] 4,128,825

[45] Dec. 5, 1978

[54] MAGNETICALLY ACTUATED INDICATOR

[75] Inventor: Elmer W. Madsen, Bristol, Conn.

[73] Assignee: North American Philips Corporation, New York, N.Y.

[21] Appl. No.: 750,008

[22] Filed: Dec. 13, 1976

[51] Int. Cl.[2] ..... H01F 7/08; H01F 7/14

[52] U.S. Cl. ..... 335/272; 340/373

[58] Field of Search ..... 335/272, 253; 340/373, 340/378; 40/28

[56] References Cited

U.S. PATENT DOCUMENTS

| | | | |
|---|---|---|---|
| 3,300,776 | 1/1967 | Fitch, Jr. et al. | 340/373 |
| 3,406,388 | 10/1968 | Pihl | 340/373 |
| 3,543,202 | 11/1970 | Naybor | 340/373 |
| 3,553,619 | 1/1971 | Skrobisch | 335/272 |
| 3,820,047 | 6/1974 | Juhnke | 335/272 |

*Primary Examiner*—Harold Broome
*Attorney, Agent, or Firm*—Robert S. Smith

[57] ABSTRACT

A magnetically actuated indicator includes a housing carrying an elongated permanent magnet for pivotal motion about a geometric axis which extends transversely to the geometric axis of the magnet. First and second poles are carried by the housing and are disposed in spaced relationship to each other and each is proximate to one end of the elongated permanent magnet in one angular position thereof. A coil is magnetically linked to the poles to change the polarity thereof and a stop prevents positioning of either end of the permanent magnet intermediate the two poles to insure consistant indications.

13 Claims, 6 Drawing Figures

MAGNETICALLY ACTUATED INDICATOR

BACKGROUND OF THE INVENTION

The present invention relates to indicators and particularly to bistable indicators which are actuated by electrical pulses to shift between the two possible stable positions. The prior art includes apparatus such as the fault detection indicator shown in U.S. Pat. No. 3,995,243 issued Nov. 30, 1976. The apparatus shown therein utilizes three permanent magnets. One of the magnets is moved axially between two bistable positions responsive to an electrical pulse through a coil. This apparatus has been satisfactory for many applications although for other applications it is desirable to produce indicators which are less vulnerable to changing position as the result of a physical shock such as a jarring movement. It is also desirable for some applications to have apparatus which is readily visible and also which exposes an indicator that is highly visible and also is not prone to be caught and disturbed by an operator or the clothing of an operator who may be working with such indicators on a panel. In other applications it is desirable to provide such apparatus which is manually resettable.

SUMMARY OF THE INVENTION

It has now been found that these requirements may be satisfied by one form of the invention which includes an indicator having a housing carrying an elongated permanent magnet having one north pole at one end and a south pole at the other end. The housing carries an elongated permanent magnet for pivotal motion about a geometric axis which extends transversly to the elongated permanent magnet at a point intermediate the ends thereof. First and second poles are carried by the housing and are disposed in spaced relationship to each other. The first pole piece is proximate to the first end of the elongated permanent magnet in one angular position of the elongated permanent magnet and the second pole is proximate to the second end of the elongated permanent magnet in another angular position of the elongated permanent magnet. A coil cooperates with the first and second poles to vary the polarity thereof in response to electrical power supplied by associated apparatus. Interfering surfaces are carried on the housing and the elongated permanent magnet to prevent movement of either end of the elongated permanent magnet passing intermediate the first and second poles.

In one form the elongated permanent magnet may be disposed in a member which is symmetrical about the geometric axis about which the elongated permanent magnet pivots. The member which is symmetrical may be manufactured of a non-ferrous material such as a plastic. The member which is symmetrical may have a generally spherical or a generally cylindrical contour and some forms may have opposite sides which are planar and parallel to each other.

The apparatus may include a member which is symmetrical which has pivot surfaces extending from the member which are also symmetrical about the axis of rotation of the member. The interfering surfaces may comprise a boss aligned generally with the axis of rotation of the member and two discrete stop members carried on the housing.

The housing may include a planar surface extending around the member which is symmetrical. In those embodiments which have a member which is symmetrical which includes planar parallel surfaces, one of said planar surfaces is disposed in parallel flush relationship to the planar surface of the housing in at least one angular position of said member which is symmetrical.

The apparatus may also include a yoke having an arm extending therefrom. The yoke carries the first and second poles and the coil is disposed around the arm. In other forms of the invention, the first and second poles are joined by a magnetically permeable member about which the coil is disposed.

BRIEF DESCRIPTION OF THE DRAWING

The invention will be better understood by reference to the accompanying drawing in which.

DESCRIPTION OF THE PREFERRED EMBODIMENT

Figure 1:
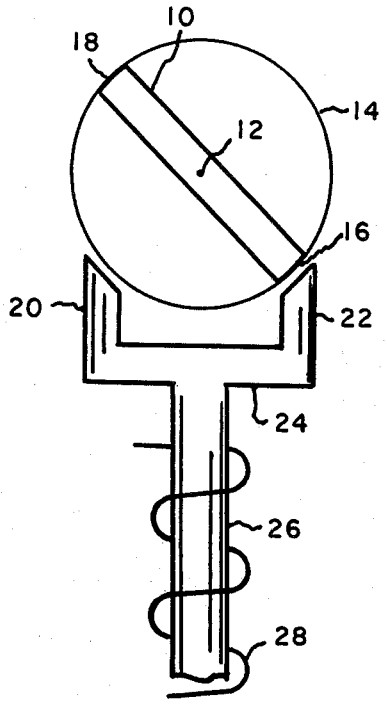
FIG. 1 is a simplified schematic view of the apparatus in accordance with one form of the invention.

Referring now to FIG. 1, there is shown elongated permanent magnet which is pivotally carried on an axis 12 and mounted in a ball 14. Cooperating with the ends 16, 18 of the elongated permanent magnet are poles 20, 22 which are mounted on a yoke 24 which is carried by an arm 26. A coil 28 is disposed around the arm 26.

In operation direct current applied in one direction to the coil 28 will cause poles 20 and 22 to have the same polarity. A stop not shown prevents rotation of the sphere 14 and pivoting of the elongated permanent magnet 10 from the position shown to any further clockwise position depending on the polarity of the end 16 of the elongated permanent magnet, there will be either a traction or repulsion between end 16 and Pole 22. If there is repulsion, the elongated permanent magnet 10 will be forced to rotate counterclockwise about pivot 12 to a position where end 18 is aligned with pole 20. This will be a stable position because the polarity of end 18 and pole 20 will be opposite and therefor attract each other. The stop (not shown) prevents rotation of the magnet 10 to a slightly more counterclockwise position, than the position where end 18 and pole 20 are aligned. When electrical power is removed from the coil 28 the magnet 10 will continue to maintain its predetermined position because that orientation is the orientation which results in the minimum reluctance.

It will be understood that the sphere 14 ordinarily will be colored in some manner to indicate which angular position is uppermost. The spacing between the poles 20 and 22 may be varied in different embodiments. In selecting that spacing, it is essential that it not be so small that a positive force is not produced to rotate the sphere 14 to a different position. The spacing will also be affected by the size of the circumferential surface which it is desired to expose in each of two stable positions of the sphere 14. In the one form of the invention the included angle from the axis 12 to the poles 20, 22 is about 90°.

Figure 2:
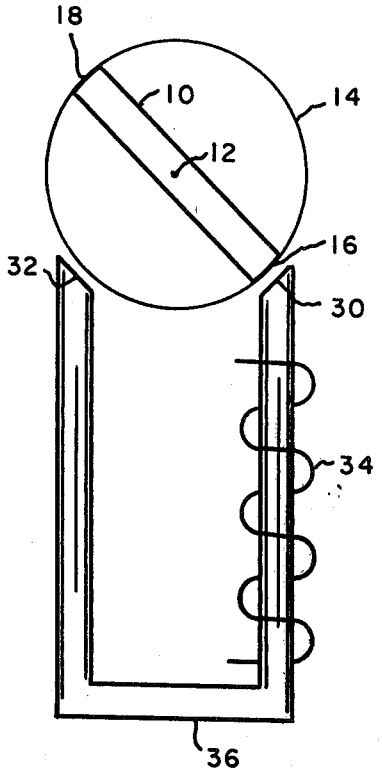
FIG. 2 is a simplified schematic view of another form of the apparatus in accordance with the invention.
Figure 4:
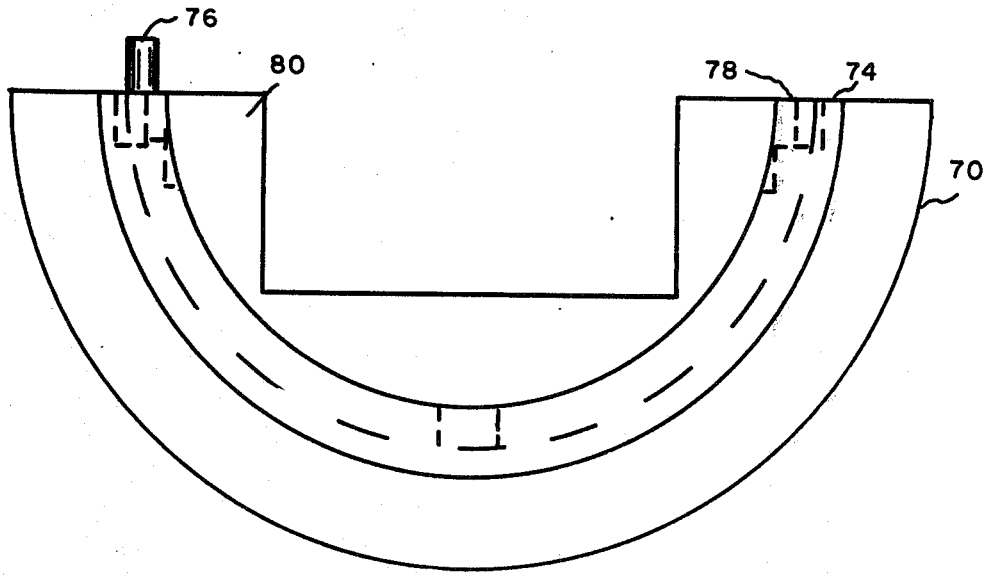
FIG. 4 is a plan view of a portion of the apparatus shown in FIG. 3.

Another embodiment of the invention is shown in FIG. 2 which is generally similar to that shown in FIG. 1. An elongated permanent magnet 10 is carried by a pivot 21 and contained within a sphere 14. Ends 16 and 18 of the magnet align themselves respectively with poles 30, 32 depending on an electric pulse provided on coil 34 which is disposed around ferrous member 36 which extends between the poles 30 and 32. As in the embodiment of FIG. 1, there is a stop (not shown) which prevents movement of either end of the magnet 10 intermediate the poles 30, 32. In either embodiment the windings 28 and 34 may be bifilar so that it is not necessary to reverse the direction of current flow through a single coil.

Referring now to FIGS. 3, 4, 5 and 6 is shown another embodiment of the invention which includes an elongated permanent magnet 42 which is disposed within a generally cylindrical member 44 and carried for rotation about the geometric axis 46 by pivot surfaces 48, 48. It will be understood that the embodiment of FIG. 1, which the member 14 has been designated as a sphere is schematically identical to the embodiment of FIGS. 3–6 even though the member 44 is a cylinder. In the embodiment of FIGS. 3–6 planar opposed parallel surfaces 50, 52 have been provided for reasons which will be described hereafter. A stop 54 cooperates with the housing 56 to prevent rotation of the magnet 42 to most positions where either end 58, 60 is intermediate the poles 62, 64.

The housing 56 includes surfaces 66 and 68 which cooperate with the stop 54 to limit the travel of the cylinder 44 about the axis 46. The housing 56 includes a flange 70 to facilitate mounting. In one form the housing 56 may be manufactured in two pieces 72 and 74 which are generally symmetrical about a vertical plane pin 76 cooperate with recesses 78 to facilitate the assembly of the two pieces. A planar upper surface 80 is flush with the surface 50 of the cylinder 44 in the position of the cylinder 44 shown in FIG. 3. In this position the indicator ordinarily will be indicating a satisfactory mode of operation of associated apparatus. When the end 58 of the magnet 42 is moved to align itself with the pole 62 an arcuate circumferential face of the cylinder 44 will be exposed above the planar surface 80 and ordinarily this will indicate some irregular mode of operation of the associated apparatus. Oridinarily the arcuate surface of the cylinder 44 which is exposed above the planar surface 80 will be of a distinctly contrasting color so that the indication will be more readily observed.

The pole 62, 64 are ferrous metal and are joined by a rivet 82 to an arm 84 which is also of ferrous metal. For simplicity the coil surrounding the arm 84 has been omitted and it will be understood that the coil will be as shown in FIG. 1. An insulating member 86 is joined by a rivet 88 to the arm 84 and terminals 90, 92 extend from the member 86 for connection of power to the coil (not shown).

The material of the cylinder 44 as well as the housing 56 must be non-ferrous and ordinarily will be plastic. The operation of the apparatus shown in FIGS. 3–6 it will be understood to be the same as that of the apparatus shown in FIG. 1.

Figure 3:
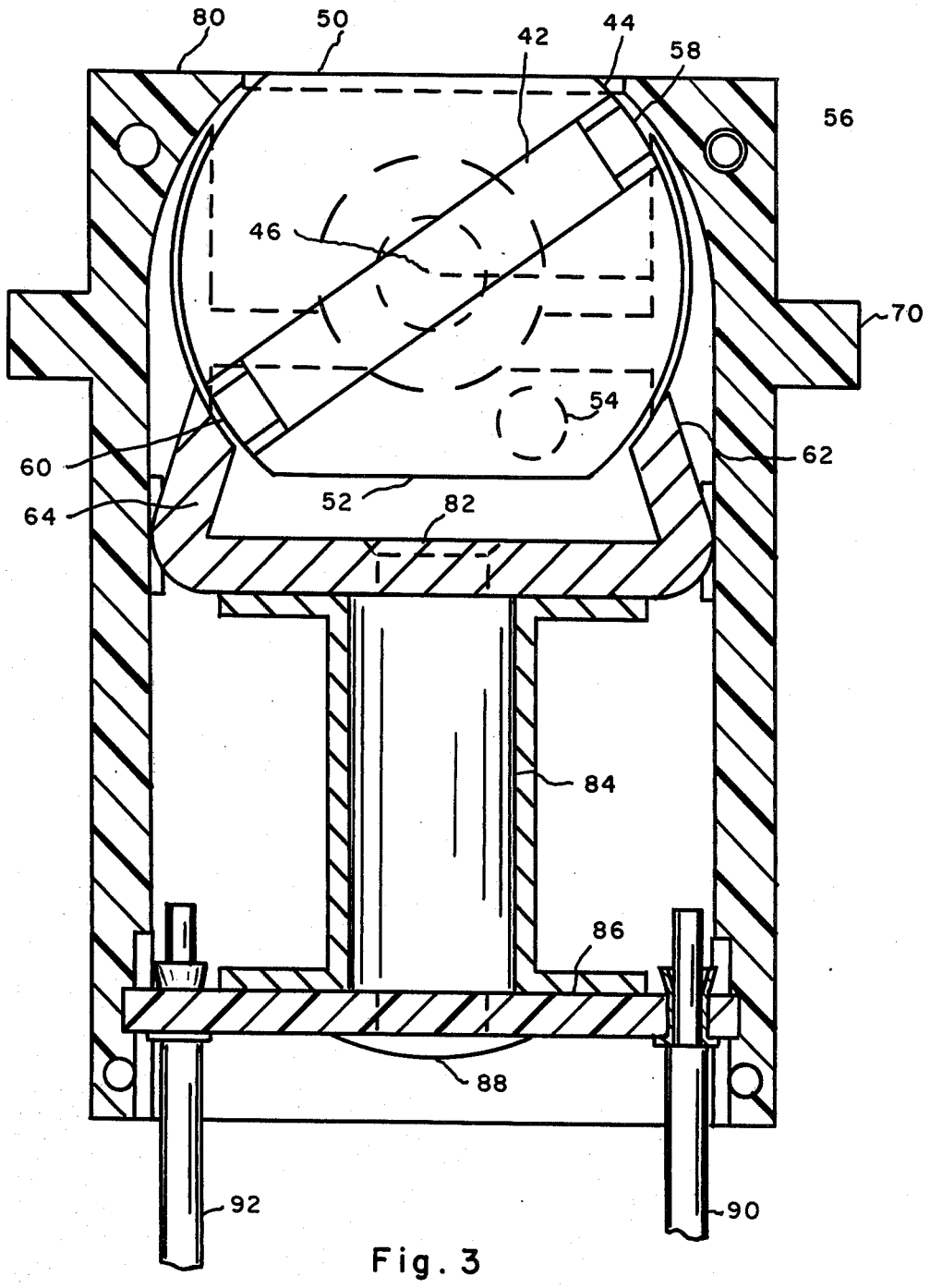
FIG. 3 is a sectional view taken through a vertical plane of the apparatus in accordance with another form of the invention.
Figure 5:
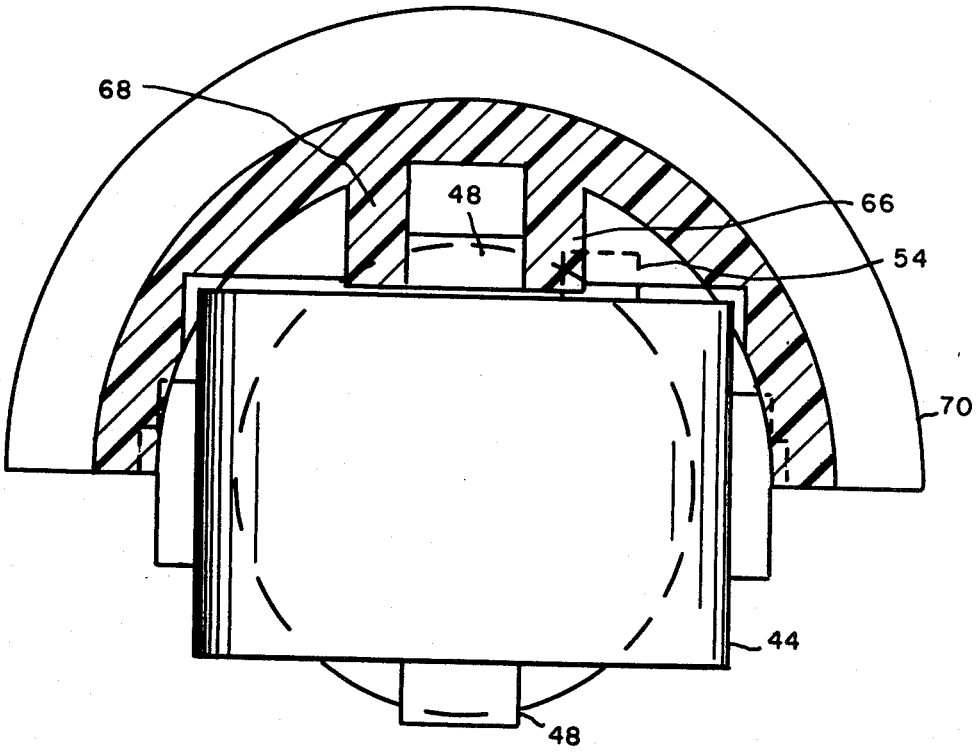
FIG. 5 is a plan view of another portion of the apparatus shown in FIG. 3.
Figure 6:
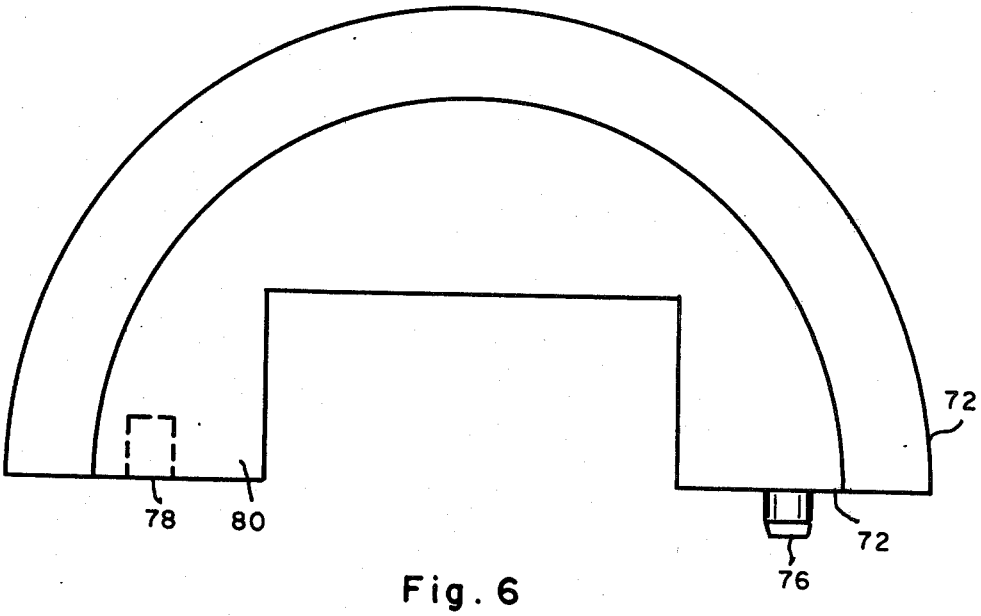
FIG. 6 is a plan view in partial section of a portion of the apparatus shown in FIG. 3.

The stop such as stop 54 shown in FIG. 3 is preferably positioned so that no mechanical interference occurs until the end of the magnet 42 moves slightly past one of the poles 62, 64 to a position intermediate the poles 62, 64. This position of the stop is desirable to minimize bouncing of the cylinder 44 as it moves to a new indicating position. The physical stop 54 is essential, however, to avoid having either end of the magnet 42 moving to a position intermediate the poles 64, 62, where the direction of rotation of magnet 42 in response to an electrical pulse would not be positively determined by the various polarities.

Having thus described my invention I claim:

1. An elongated permanent magnet having one north pole at a first end and a south pole at the second end;

means for pivoting said magnet about a geometric axis which extends transversly to the geometric axis of said elongated permanent magnet at a point intermediate said ends thereof, said means for pivoting allowing rotational travel of said magnet between a first angular position and a second angular position;

first and second poles carried by said housing and disposed in spaced relationship to each other, said first pole being proximate to said one end of said elongated magnet in said one angular position of said elongated permanent magnet and said second pole being proximate to said second end of said elongated permanent magnet in said second angular position of said elongated permanent magnet;

a coil cooperating with said first and second poles to vary the polarity thereof; and interfering surfaces carried on said housing and said elongated permanent magnet to prevent angular movement of either end of said elongated permanent magnet past a point intermediate said first and second pole, said interfering surfaces being spaced from both said first and second poles.

2. The apparatus as described in claim 1 wherein said elongated permanent magnet is disposed in a member which is symmetrical about said geometric axis which said elongated permanent magnet pivots.

3. The apparatus as described in claim 2 wherein said member which is symmetrical is manufactured of a non-ferrous material.

4. The apparatus as described in claim 3 wherein said material is a plastic.

5. The apparatus as described in claim 3 wherein said member which is symmetrical is generally cylindrical.

6. The apparatus as described in claim 3 wherein said member which is symmetrical is generally spherical.

7. The apparatus as described in claim 4 wherein said member which is symmetrical has pivot surfaces extending from the member, said pivot surfaces being symmetrical about said axis or rotation of said elongated permanent magnet.

8. The apparatus as described in claim 7 wherein said interfering surfaces comprise a boss aligned generally with said axis of rotation of said member which is symmetrical and also at least one descrete stop member carried on said housing.

9. The apparatus as described in claim 8 where said housing has a planar surface extending around said member which is symmetrical.

10. The apparatus as described in claim 9 wherein said member which is symmetrical has two opposite sides thereof which are planar and parallel to each other, one of said planar sides being disposed in parallel flush relationship to said planar surface of said housing.

11. The apparatus as described in claim 1 further including a yoke and an arm extending therefrom, said yoke carrying said first and second poles and said coil is disposed around said arm.

12. The apparatus as described in claim 1 wherein said first and second poles are joined by a magnetically permeable member about which said coil is disposed.

13. The apparatus as described claim 1, wherein said interfering surfaces are disposed to interfere only when said elongated permanent magnet is disposed with one end intermediate said first and second poles.

* * * * *

UNITED STATES PATENT OFFICE

CERTIFICATE OF CORRECTION

Patent No. 4,128,825 Dated December 5, 1978

Inventor(s) Elmer W. Madsen

It is certified that error appears in the above-identified patent and that said Letters Patent are hereby corrected as shown below:

Col. 4 line 43, After "axis" delete "or" and insert -- of --

Signed and Sealed this

*Twenty-fourth* Day of *February 1981*

[SEAL]

*Attest:*

RENE D. TEGTMEYER

*Attesting Officer*

*Acting Commissioner of Patents and Trademarks*